United States Patent [19]

Kosuka

[11] Patent Number: 4,935,730

[45] Date of Patent: Jun. 19, 1990

[54] DISPLAY APPARATUS

[75] Inventor: Toshiya Kosuka, Chiyoda, Japan

[73] Assignee: Sanyo Electric Co., Ltd., Osaka, Japan

[21] Appl. No.: 226,569

[22] Filed: Aug. 1, 1988

Related U.S. Application Data

[63] Continuation of Ser. No. 775,494, Sep. 12, 1985, abandoned.

[30] Foreign Application Priority Data

| | | | |
|---|---|---|---|
| Oct. 16, 1984 | [JP] | Japan | 59-217015 |
| Oct. 18, 1984 | [JP] | Japan | 59-219944 |
| Oct. 18, 1984 | [JP] | Japan | 59-219945 |
| Oct. 18, 1984 | [JP] | Japan | 59-219946 |

[51] Int. Cl.[5] ..... G09G 1/16

[52] U.S. Cl. ..... 340/723; 340/703; 340/750

[58] Field of Search ..... 340/703, 721, 723, 724, 340/750, 798, 799

[56] References Cited

U.S. PATENT DOCUMENTS

| | | | |
|---|---|---|---|
| Re. 31,200 | 4/1983 | Sukonick et al. . | |
| 4,070,710 | 1/1978 | Sukonick et al. | 340/721 |
| 4,197,590 | 4/1980 | Sukonick . | |
| 4,278,973 | 7/1981 | Hughes et al. | 340/721 |
| 4,414,294 | 10/1983 | Watts et al. | 340/726 |
| 4,484,302 | 11/1984 | Cason et al. | 340/721 |
| 4,491,836 | 1/1985 | Collmeyer et al. | 340/721 |
| 4,509,043 | 4/1985 | Mossaides | 340/703 |
| 4,550,315 | 10/1985 | Bass et al. | 340/799 |
| 4,555,775 | 11/1985 | Pike | 340/734 |

FOREIGN PATENT DOCUMENTS

| | | |
|---|---|---|
| 0018959 | 11/1980 | European Pat. Off. . |
| 0061213 | 9/1982 | European Pat. Off. . |
| 0069518 | 1/1983 | European Pat. Off. . |
| 0071725 | 2/1983 | European Pat. Off. . |
| 0095618 | 7/1983 | European Pat. Off. . |
| 0099989 | 2/1984 | European Pat. Off. . |
| 0106201 | 5/1984 | European Pat. Off. . |
| 59-143192 | 8/1984 | Japan . |
| 61-84687 | 4/1986 | Japan . |
| 61-91486 | 5/1986 | Japan . |
| 61-98385 | 5/1986 | Japan . |
| 61-98387 | 5/1986 | Japan . |

*Primary Examiner*—David K. Moore
*Assistant Examiner*—M. Fatahiyar
*Attorney, Agent, or Firm*—Darby & Darby

[57] ABSTRACT

A display apparatus to be utilized in computers, which is provided with an image memory having a plurality of planes. The apparatus is capable of displaying the contents stored in all the planes by superimposing, selecting a desired portion of the stored content of each plane to display the desired portion in the optional position on a screen, thereby displaying stored contents of the respective planes simultaneously in one screen, and moving the displayed image by selecting the planes by the dot line. The apparatus, therefore, has various display functions. For the above purpose, the display apparatus comprises a control memory for storing plane selecting data with respect to screen address is designated on regions on the screen partitioned into every moderate size so that the plane to be displayed is selected by the stored content in the control memory.

8 Claims, 18 Drawing Sheets

| B 11 | B 12 | SELECTED PLANE |
|---|---|---|
| 0 | 0 | B |
| 0 | 1 | R |
| 1 | 0 | G |
| 1 | 1 | I |

FIG. 14

| Y | RA | LA |
|---|---|---|
| 0 | 0 | 0 |
| 0 | 1 | 1 |
| 0 | 2 | 2 |
| ⋮ | ⋮ | ⋮ |
| 0 | 7 | 7 |
| 1 | 0 | 8 |
| 1 | 1 | 9 |
| 1 | 2 | 10 |
| ⋮ | ⋮ | ⋮ |
| 1 | 7 | 15 |
| 2 | 0 | 16 |
| ⋮ | ⋮ | ⋮ |
| 6 | 7 | 55 |
| 7 | 0 | 56 |
| 7 | 1 | 57 |
| 7 | 2 | 58 |
| ⋮ | ⋮ | ⋮ |
| 7 | 7 | 63 |

FIG. 15

| M | A | X | Y | B11 | B12 |
|---|---|---|---|---|---|
| 0 | 1 | 0 | 0 | 0 | 1 |
| 2 | 3 | 1 | 0 | 0 | 1 |
| 4 | 5 | 2 | 0 | 0 | 1 |
| 6 | 7 | 3 | 0 | 0 | 1 |
| 8 | 9 | 6 | 4 | 0 | 0 |
| 10 | 11 | 7 | 4 | 0 | 0 |
| 12 | 13 | 0 | 1 | 0 | 1 |
| 14 | 15 | 1 | 1 | 0 | 1 |
| 16 | 17 | 2 | 1 | 0 | 1 |
| 18 | 19 | 3 | 1 | 0 | 1 |
| 20 | 21 | 6 | 5 | 0 | 0 |
| 22 | 23 | 7 | 5 | 0 | 0 |
| 24 | 25 | 4 | 0 | 1 | 1 |
| 26 | 27 | 5 | 0 | 1 | 1 |
| 28 | 29 | 6 | 0 | 1 | 1 |
| 30 | 31 | 7 | 0 | 1 | 1 |
| 32 | 33 | 6 | 6 | 0 | 0 |
| 34 | 35 | 7 | 6 | 0 | 0 |
| 36 | 37 | 4 | 1 | 1 | 1 |
| 38 | 39 | 5 | 1 | 1 | 1 |
| 40 | 41 | 6 | 1 | 1 | 1 |
| 42 | 43 | 7 | 1 | 1 | 1 |
| 44 | 45 | 6 | 7 | 0 | 0 |
| 46 | 47 | 7 | 7 | 0 | 0 |
| 48 | 49 | 4 | 2 | 1 | 1 |
| 50 | 51 | 5 | 2 | 1 | 1 |
| 52 | 53 | 6 | 2 | 1 | 1 |
| 54 | 55 | 7 | 2 | 1 | 1 |
| 56 | 57 | 0 | 0 | 1 | 0 |
| 58 | 59 | 1 | 0 | 1 | 0 |
| 60 | 61 | 4 | 3 | 1 | 1 |
| 62 | 63 | 5 | 3 | 1 | 1 |
| 64 | 65 | 6 | 3 | 1 | 1 |
| 66 | 67 | 7 | 3 | 1 | 1 |
| 68 | 69 | 0 | 1 | 1 | 0 |
| 70 | 71 | 1 | 1 | 1 | 0 |

FIG. 18

| MA | | X | Y | B11 | B12 | B15 |
|---|---|---|---|---|---|---|
| 0 | 1 | 0 | 0 | 0 | 1 | 1 |
| 2 | 3 | 1 | 0 | 0 | 1 | 1 |
| 4 | 5 | 2 | 0 | 0 | 1 | 1 |
| 6 | 7 | 3 | 0 | 0 | 1 | 1 |
| 8 | 9 | 6 | 4 | 0 | 0 | 1 |
| 10 | 11 | 7 | 4 | 0 | 0 | 1 |
| 12 | 13 | 0 | 1 | 0 | 1 | 1 |
| 14 | 15 | 1 | 1 | 0 | 1 | 1 |
| 16 | 17 | 2 | 1 | 0 | 1 | 1 |
| 18 | 19 | 3 | 1 | 0 | 1 | 1 |
| 20 | 21 | 6 | 5 | 0 | 0 | 1 |
| 22 | 23 | 7 | 5 | 0 | 0 | 1 |
| 24 | 25 | 6 | 0 | 1 | 1 | 1 |
| 26 | 27 | 7 | 0 | 1 | 1 | 1 |
| 28 | 29 | 0 | 4 | 0 | 0 | 0 |
| 30 | 31 | 1 | 4 | 0 | 0 | 0 |
| 32 | 33 | 6 | 6 | 0 | 0 | 1 |
| 34 | 35 | 7 | 6 | 0 | 0 | 1 |
| 36 | 37 | 6 | 1 | 1 | 1 | 1 |
| 38 | 39 | 7 | 1 | 1 | 1 | 1 |
| 40 | 41 | 0 | 5 | 0 | 0 | 0 |
| 42 | 43 | 1 | 5 | 0 | 0 | 0 |
| 44 | 45 | 6 | 7 | 0 | 0 | 1 |
| 46 | 47 | 7 | 7 | 0 | 0 | 1 |
| 48 | 49 | 6 | 2 | 1 | 1 | 1 |
| 50 | 51 | 7 | 2 | 1 | 1 | 1 |
| 52 | 53 | 0 | 6 | 0 | 0 | 0 |
| 54 | 55 | 1 | 6 | 0 | 0 | 0 |
| 56 | 57 | 0 | 6 | 1 | 0 | 1 |
| 58 | 59 | 1 | 0 | 1 | 0 | 1 |
| 60 | 61 | 6 | 3 | 1 | 1 | 1 |
| 62 | 63 | 7 | 3 | 1 | 1 | 1 |
| 64 | 65 | 0 | 7 | 0 | 0 | 0 |
| 66 | 67 | 1 | 7 | 0 | 0 | 0 |
| 68 | 69 | 0 | 1 | 1 | 0 | 1 |
| 70 | 71 | 1 | 1 | 1 | 0 | 1 |

FIG. 19
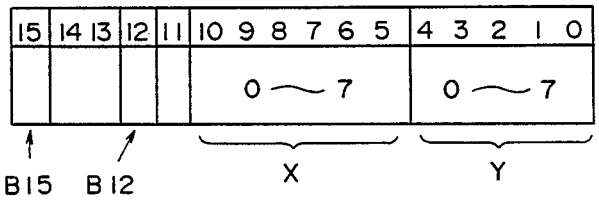
FIG. 20
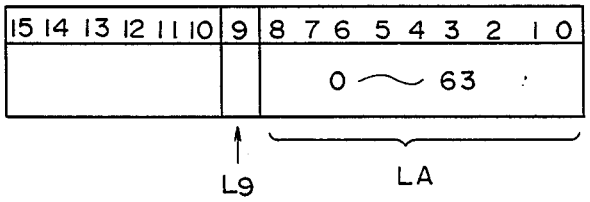
FIG. 21
| L9 | B12 | SELECTED PLANE |
|---|---|---|
| 0 | 0 | B |
| 0 | 1 | R |
| 1 | 0 | G |
| 1 | 1 | I |

FIG. 24

| MA | | X | Y | B12 |
|---|---|---|---|---|
| 0 | 1 | 5 | 0 | 0 |
| 2 | 3 | 6 | 0 | 0 |
| 4 | 5 | 7 | ⋮ | 0 |
| 6 | 7 | 0 | ⋮ | 1 |
| 8 | 9 | 1 | ⋮ | 1 |
| 10 | 11 | 2 | 0 | 1 |
| 12 | 13 | 5 | 1 | 0 |
| 14 | 15 | 6 | 1 | 0 |
| 16 | 17 | 7 | ⋮ | 0 |
| 18 | 19 | 0 | ⋮ | 1 |
| 20 | 21 | 1 | ⋮ | 1 |
| 22 | 23 | 2 | 1 | 1 |
| 24 | 25 | 5 | 2 | 0 |
| 26 | 27 | 6 | 2 | 0 |
| 28 | 29 | 7 | ⋮ | 0 |
| 30 | 31 | 0 | ⋮ | 1 |
| 32 | 33 | 1 | ⋮ | 1 |
| 34 | 35 | 2 | 2 | 1 |
| 36 | 37 | 5 | 3 | 0 |
| 38 | 39 | 6 | 3 | 0 |
| 40 | 41 | 7 | ⋮ | 0 |
| 42 | 43 | 0 | ⋮ | 1 |
| 44 | 45 | 1 | ⋮ | 1 |
| 46 | 47 | 2 | 3 | 1 |
| 48 | 49 | 5 | 4 | 0 |
| 50 | 51 | 6 | 4 | 0 |
| 52 | 53 | 7 | ⋮ | 0 |
| 54 | 55 | 0 | ⋮ | 1 |
| 56 | 57 | 1 | ⋮ | 1 |
| 58 | 59 | 2 | 4 | 1 |
| 60 | 61 | 5 | 5 | 0 |
| 62 | 63 | 6 | 5 | 0 |
| 64 | 65 | 7 | ⋮ | 0 |
| 66 | 67 | 0 | ⋮ | 1 |
| 68 | 69 | 1 | ⋮ | 1 |
| 70 | 71 | 2 | 5 | 1 |

FIG. 25

| Y | RA | LA | L9 |
|---|---|---|---|
| 0 | 0 | 40 | 0 |
| 0 | 1 | 41 | 0 |
| 0 | 2 | 42 | ⋮ |
| ⋮ | ⋮ | ⋮ | ⋮ |
| 0 | 7 | 47 | ⋮ |
| 1 | 0 | 48 | ⋮ |
| 1 | 1 | 49 | ⋮ |
| ⋮ | ⋮ | ⋮ | ⋮ |
| 1 | 7 | 55 | ⋮ |
| 2 | 0 | 56 | ⋮ |
| 2 | 1 | 57 | ⋮ |
| ⋮ | ⋮ | ⋮ | ⋮ |
| 2 | 6 | 62 | 0 |
| 2 | 7 | 63 | 0 |
| 3 | 0 | 0 | 1 |
| 3 | 1 | 1 | 1 |
| 3 | 2 | 2 | ⋮ |
| ⋮ | ⋮ | ⋮ | ⋮ |
| 3 | 7 | 7 | ⋮ |
| 4 | 0 | 8 | ⋮ |
| 4 | 1 | 9 | ⋮ |
| ⋮ | ⋮ | ⋮ | ⋮ |
| 4 | 7 | 15 | ⋮ |
| 5 | 0 | 16 | ⋮ |
| 5 | 1 | 17 | ⋮ |
| ⋮ | ⋮ | ⋮ | ⋮ |
| 5 | 7 | 23 | 1 |

FIG. 28

| MA | | X | Y | B12 | B15 |
|---|---|---|---|---|---|
| 0 | 1 | 0 | 0 | 0 | 0 |
| 2 | 3 | 1 | 0 | 0 | 0 |
| 4 | 5 | 2 | | | |
| 6 | 7 | 3 | | | |
| 8 | 9 | 4 | | | |
| 10 | 11 | 5 | 0 | | |
| 12 | 13 | 0 | 1 | | |
| 14 | 15 | 1 | 1 | | |
| 16 | 17 | 2 | | | |
| 18 | 19 | 3 | | | |
| 20 | 21 | 4 | | | |
| 22 | 23 | 5 | 1 | 0 | 0 |
| 24 | 25 | 0 | 2 | 0 | 1 |
| 26 | 27 | 1 | 2 | 0 | 1 |
| 28 | 29 | 2 | | 0 | |
| 30 | 31 | 3 | | 0 | |
| 32 | 33 | 4 | | 1 | |
| 34 | 35 | 5 | 2 | 1 | |
| 36 | 37 | 0 | 3 | 0 | |
| 38 | 39 | 1 | 3 | 0 | |
| 40 | 41 | 2 | | 0 | |
| 42 | 43 | 3 | | 0 | |
| 44 | 45 | 4 | | 1 | |
| 46 | 47 | 5 | 3 | 1 | |
| 48 | 49 | 4 | 4 | 0 | |
| 50 | 51 | 5 | 4 | 0 | |
| 52 | 53 | 6 | | 0 | |
| 54 | 55 | 7 | | 0 | |
| 56 | 57 | 2 | | 1 | |
| 58 | 59 | 3 | 4 | 1 | |
| 60 | 61 | 4 | 5 | 0 | |
| 62 | 63 | 5 | 5 | 0 | |
| 64 | 65 | 6 | | 0 | |
| 66 | 67 | 7 | | 0 | |
| 68 | 69 | 2 | | 1 | |
| 70 | 71 | 3 | 5 | 1 | 1 |

FIG. 29

| Y | RA | LA | L9 |
|---|---|---|---|
| 0 | 0 | 32 | 0 |
| | 1 | 33 | 0 |
| 0 | 7 | 39 | |
| 1 | 0 | 40 | |
| | 6 | 46 | |
| 1 | 7 | 47 | 0 |
| 2 | 0 | 16 | 0 |
| | 1 | 17 | 0 |
| | 2 | 18 | |
| 2 | 7 | 23 | |
| 3 | 0 | 24 | |
| | 6 | 30 | 0 |
| 3 | 7 | 31 | 0 |
| 4 | 0 | 0 | 1 |
| | 1 | 1 | 1 |
| | 2 | 2 | |
| 4 | 7 | 7 | |
| 5 | 0 | 8 | |
| | 6 | 14 | 1 |
| 5 | 7 | 15 | 1 |

DISPLAY APPARATUS

This is a continuation, of application Ser. No. 775,494, filed Sept. 12, 1985 now abandoned.

BACKGROUND OF THE INVENTION

1. Field of the Invention

This invention relates to a raster scan type display apparatus provided with an image memory having a plurality of planes and suitable for carrying out a graphic display.

2. Description of the Prior Art

The Japanese Patent Laid-Open Gazette No. Sho 59-114581 has disclosed a display apparatus which is provided with first and second plane memories to display the contents thereof in a raster scan type display, the display apparatus being provided with a video selecting switch, a video selector for generating plane selecting signals corresponding to assignment by the video selecting switch, and an AND gate connected to the output of each plane memory and switched in response to plane selecting signals so that the contents of first and second plane memories are displayed simultaneously or separately.

Such conventional art selects the plane memory corresponding to operation of the video selecting switch, whereby the content of each plane memory merely is displayed independently on the entire screen, or the contents of both the plane memories are merely superposed on the entire screen.

In other words, when the plane is selected, the content of each plane cannot be displayed inclusively on one screen.

OBJECT OF THE INVENTION

A first object of the invention is to provide a display apparatus which has image memory having a plurality of planes and can display the contents of the respective planes in a superimposed manner and display the content of a desired portion at a desired plane at an optional position on the screen.

A second object of the invention is to provide a display apparatus which is capable of grasping simultaneously on one screen each independent processing condition when a plurality of planes are assigned to a plurality of programs respectively.

A third object of the invention is to provide a display apparatus which can display at the desired position on the screen the content of the desired portion of the desired plane, and which can display at the desired position on the screen the contents of the same portions (but optional) superposed on each other.

A fourth object of the invention is to provide a display apparatus which can display on desired dot line on the screen the contents of the portions corresponding to the desired dot lines on the desired plane.

A fifth object of the invention is to provide a display apparatus which is adapted to have depicted in the image memory an image across a plurality of planes so that the desired part of the image can be displayed on the screen and scrolled thereon.

A sixth object of the invention is to provide a display apparatus which can display on the desired dot line on the screen the content of the portion corresponding to the desired dot line of the desired plane and which also can display on the desired dot line on the screen the contents of the portions corresponding to the same dot lines (but optional) at the respective planes in a superinposed manner on each other.

The above and further objects and features of the invention will more fully be apparent from the following detailed description with reference to accompanying drawings.

BRIEF DESCRIPTION OF THE DRAWINGS

FIG. 14 shows the contents stored in the line address map memory, FIG. 15 shows the contents stored in the block address map memory, FIG. 18 shows the contents stored in the block address map memory, FIG. 19 is a format of the contents stored in the block address map memory, FIG. 20 is a format of the contents stored in the line address map memory, FIG. 21 shows a relation between the plane selecting data and the selected planes, FIG. 24 shows the contents stored in the block address map memory, FIG. 25 shows the contents stored in the line address map memory, FIG. 28 shows the contents stored in the block address map memory, and FIG. 29 shows the contents stored in the line address map memory.

DETAILED DESCRIPTION OF THE INVENTION

Firstly, in FIGS. 1 through 3, the display apparatus of the invention will be described in summary of its function for the sake of easy understanding thereof.

An image memory has a plurality (herein four) of planes 1R, 1G, 1B and 1I, the capacity of each of which is larger than the display quantity of the entire dots on a screen of a cathode-ray tube (CRT) 30. The most fundamental function of the image memory, as shown in FIG. 1, is that the content of an area 1R1 of the memory plane 1R is displayed in a region 30*a* on the screen of CRT30, the same of an area 1G1 of the memory plane 1G in a region 30*b*, the same of an area 1I1 of the memory plane 1I in a region 30*c*, the same of an area 1R2 of the memory plane 1R in a region 30*d*, and the same of an area 1B1 of the memory plane 1B in a region 30*e*. In addition, the region on the screen of CRT30 and the area of each memory plane 1R, 1G, 1B or 1I can carry out their division assignments optionally by the unit of a predetermined memory block.

Figure 2:
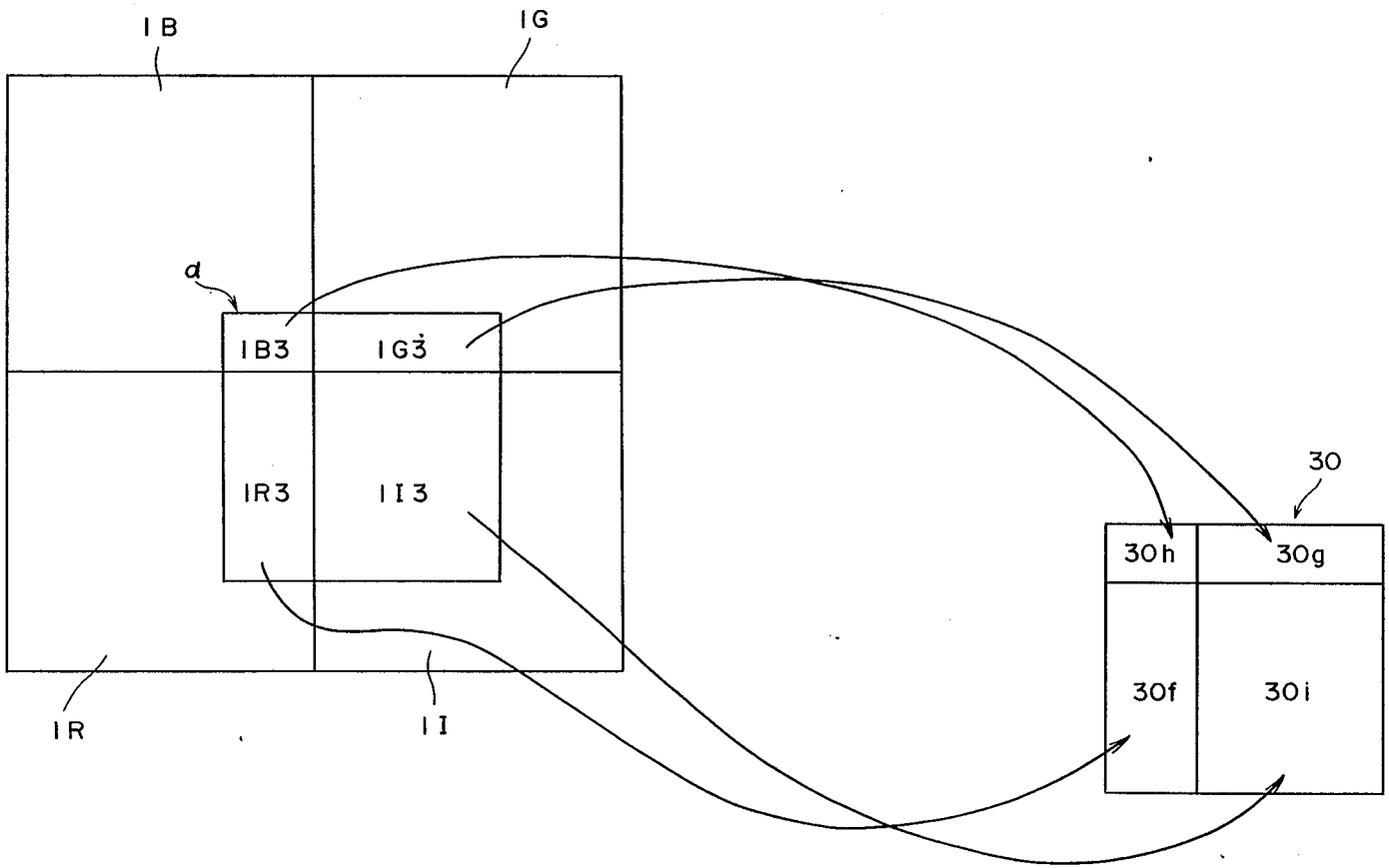

Referring to FIG. 2, another function of the display apparatus of the invention is shown, which allows the memory planes to store therein a larger image across the four memory planes 1R, 1G, 1B and 1I, the larger image displaying its desired portion $\alpha$ on the screen of CRT30.

Figure 1:
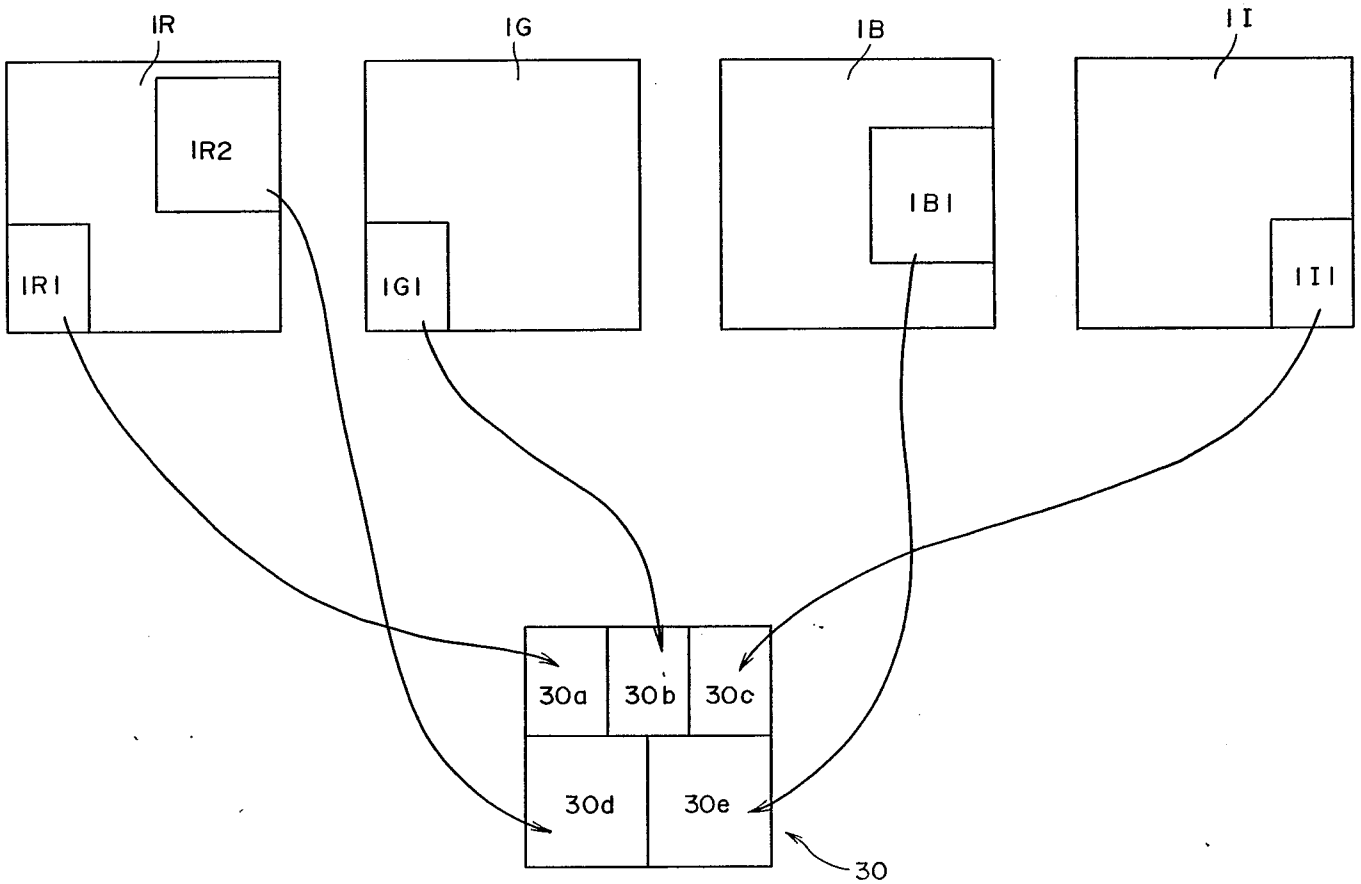
FIGS. 1, 2 and 3 are illustrations of the function of a display apparatus of the invention.

The function shown in FIG. 2, which displays areas 1R3, 1G3, 1B3 and 1I3 of memory planes 1R, 1G, 1B and 1I in regions 30*f*, 30*g*, 30*h* and 30*i* on the screen of CRT30, is the same as that in FIG. 1. However, the division assignment of each area at the memory plane to be displayed is changed by the dot line, thereby enabling the portion $\alpha$ to be smoothly changed.

Figure 3:
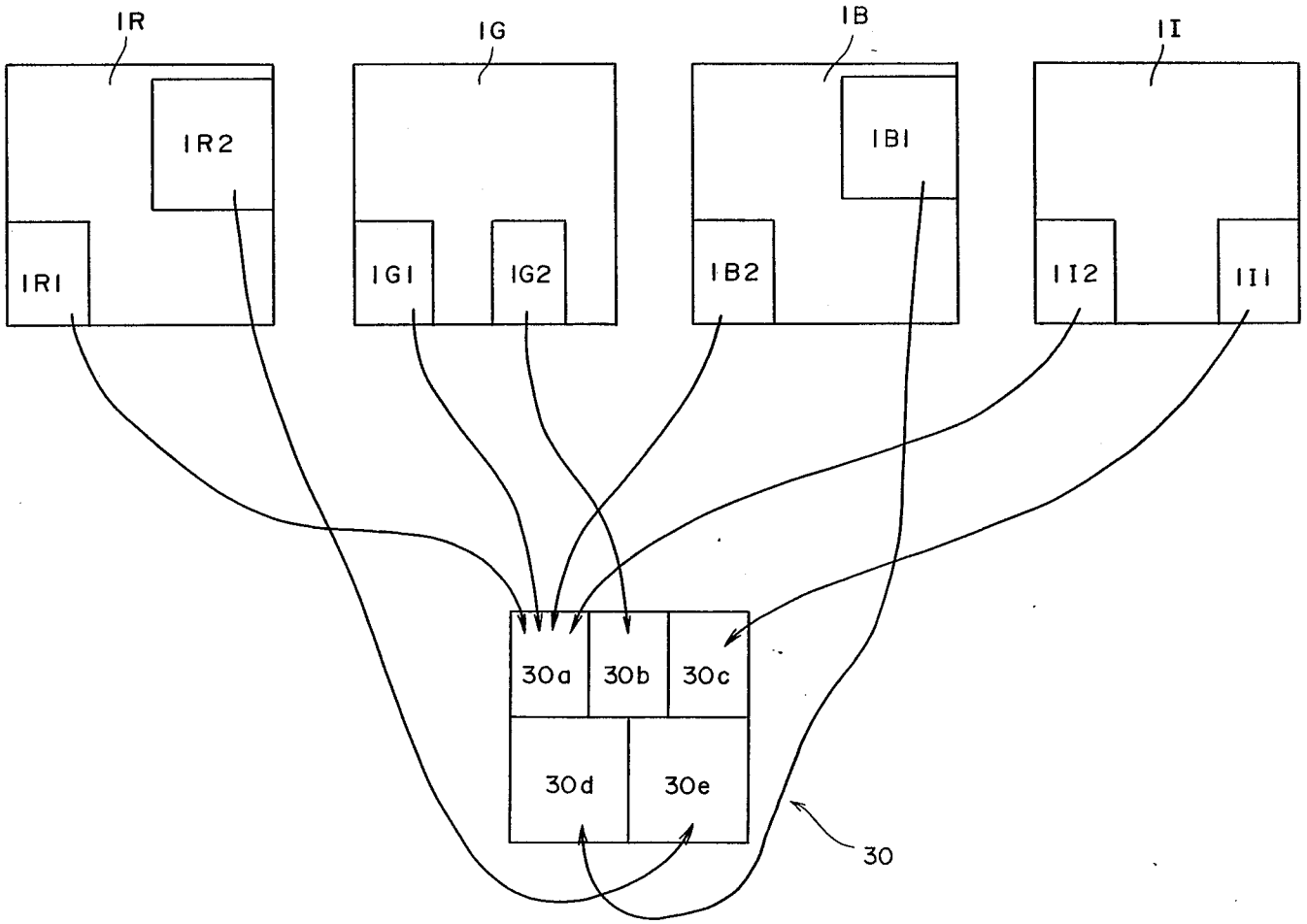

Referring to FIG. 3, still another function of the display apparatus of the invention is shown, which displays in a region 30*a* on the screen of CRT30 the same address areas 1R1, 1G1, 1B2 and 1I2 superposed on each other, other regions 30*b*, 30*c*, 30*d* and 30*e* on the screen of CRT30, as the same as in FIG. 1, displaying the content of an area 1G2 of memory plane 1G, that of area 1I1 of memory plane 1I, that of area 1B1 of memory plane 1B and that of area 1R2 of memory plane 1R.

Figure 4:
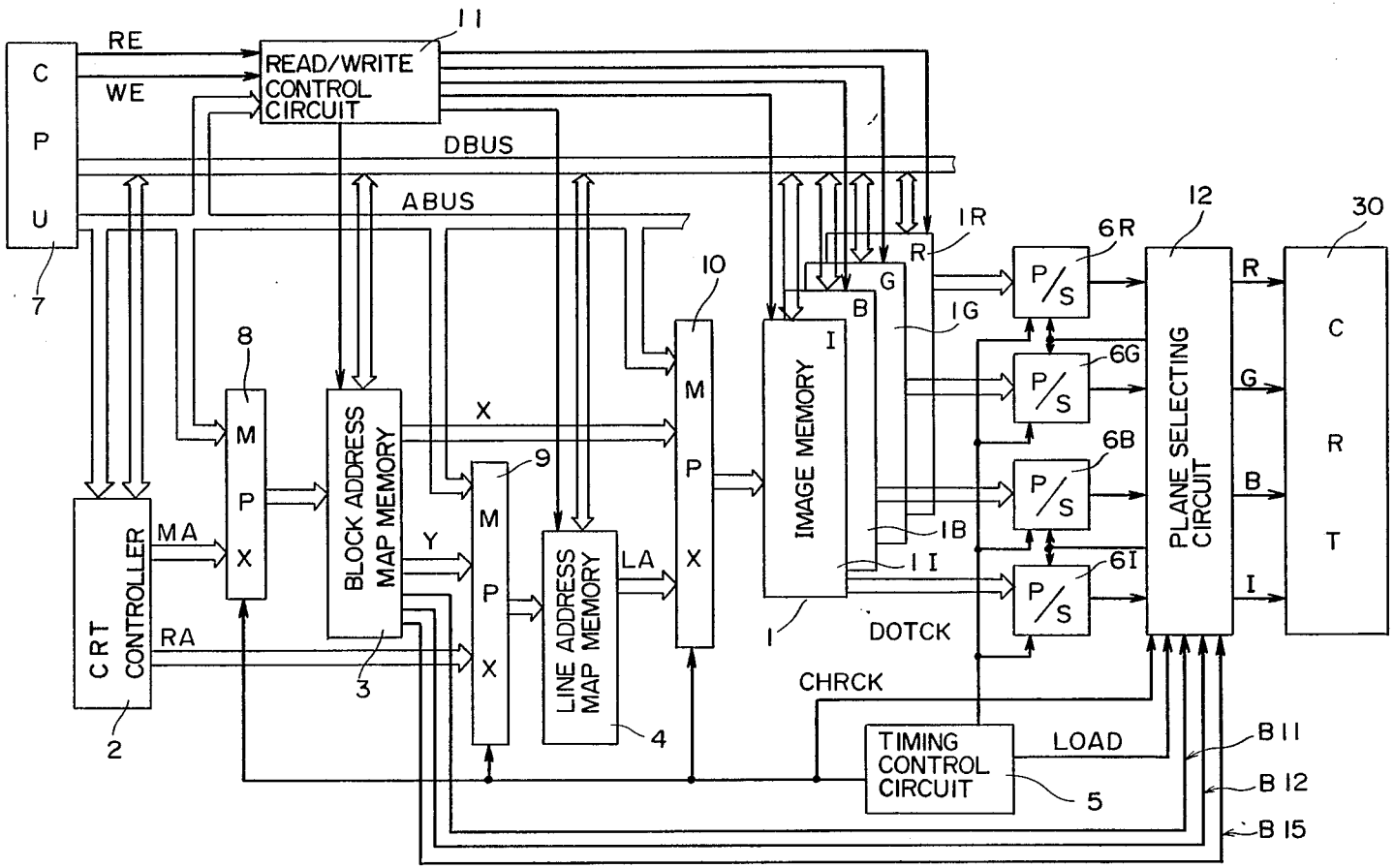
FIG. 4 is a block diagram of a first embodiment of a display apparatus of the invention.

Next, embodiments of the display apparatus of the invention will be detailed as follows:

FIG. 4 is a block diagram of a first embodiment of the invention, in which reference numeral 1 designates an image memory comprising four planes 1R, 1G, 1B and 1I corresponding to red, green, blue and intensity respectively, one plane having a capacity larger than one frame, 2 designates a CRT controller for generating the screen address MA and raster address RA, 3 designates a block address map memory which is rewritable and given the screen address MA as the address so that the screen address MA is converted into the block address comprising column address X and row address Y, 4 designates a line address map memory which is given the row address Y and raster address RA as the addresses, thereby converting both the address informations into the line addresses, 5 designates a timing control circuit generating timing signals, such as dot clock signals DOTCK, character clock signals CHRCK, and load signals LOAD, 6R through 6I designate parallel/-serial conversion circuits P/S which convert into serial data on the basis of the dot clock DOTCK the parallel image data read out from the planes 1R through 1I respectively, 7 designates a central processing unit (CPU) for writing data into both the map memories 3 and 4 and the image memory 1 through a data bus DBUS, 8 through 10 designate multiplexers MPX for selecting corresponding to the character clock CHRCK the address given from the CPU7 through the address bus ABUS and that given from the CRT controller 2 or the map memories 3 and 4, 11 designates a read/write control circuit which is given the address, read enable signal RE and write enable signal WE, from CPU7, carries out memory-selection for the map memories 3 and 4 and planes 1R, 1G, 1B and 1I at the image memory, and controls read/write, 12 designates a plane selecting circuit (reffer to FIG. 9), and 30 designates a cathode-ray tube (CRT).

Figure 5:
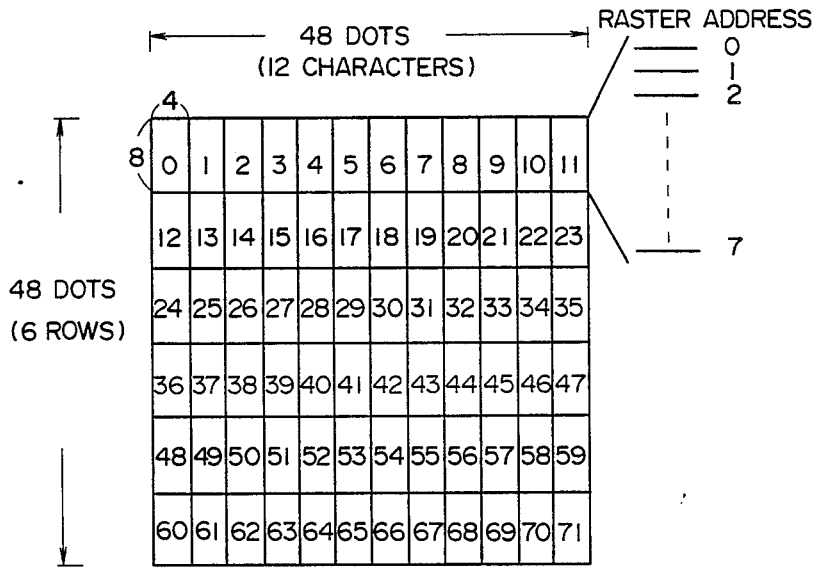
FIG. 5 is an illustration of screen addresses and raster addresses in the first embodiment.

Next, explanation will be given on the screen address and raster address regarding the screen of CRT30. The screen of CRT30, as shown in FIG. 5, comprises $48\times48$ dots, one character comprising 8 dots long and 4 dots broad (in brief, 12 characters$\times$6 rows).

The screen address MA represents the screen location of display space of $4\times8$ dots corresponding to one character and the screen addresses 0 to 71 are assigned from the left upper end to the right lower end of the screen. The raster address RA shows the position of raster to be scanned in one display space on the screen specified by the screen address, thereby assigning raster addresses 0 to 7 per one row, namely one display space.

The CRT controller 2 generates in the order the raster addresses RA from 0 to 7, while it being repeated the screen addresses MA of 0 to 71 are generated in the order. In other words, the screen addresses MA of 0 to 11 corresponding to the 1st row are generated per one raster address RA. In brief, during the raster address RA=0, the screen address MA is changed from 0 to 11 and then during the raster address RA=1, the screen address MA is changed from 0 to 11. After the screen address MA is changed from 0 to 11 with respect to the raster address RA=7, the screen addresses MA are generated corresponding to the second row, so that during the raster address RA=0, the screen address MA is changed from 12 to 23 and so on. Thus, the screen addresses MA are generated eight times on every row.

Next, explanation will be given on construction of the address for each plane at the image memory 1.

Figure 6:
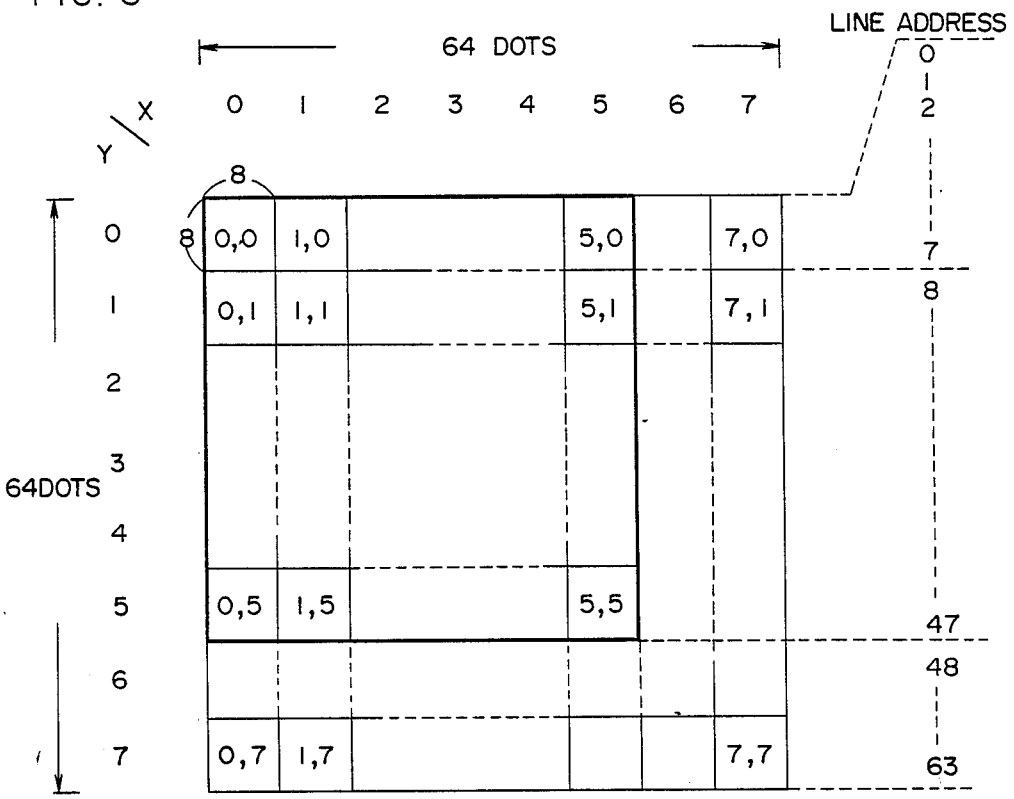
FIG. 6 is an illustration of block addresses and line addresses in the same.

Each plane, as shown in FIG. 6, has a capacity of $64\times64$ dots more than $48\times48$ dots of the screen of CRT30, is partitioned into memory blocks of $8\times8$ dots, and represents the coordinate of each memory block by block addresses (0, 0) to (7, 7) comprising the column addresses X and row addresses Y. Also, the line address LA is partitioned into 0 to 63 in row corresponding to one dot line on the screen of CRT30.

Such block address (X, Y) and line address are adapted to be written in the block address map memory 3 and line address map memory 4, an area shown by the thick line in FIG. 6 corresponding to the capacity of one screen.

The CRT controller 2, as the above-mentioned, generates the screen address MA, which is given to the block address map memory 3 and converted into the block address (X, Y) by the data stored in the memory 3 through CPU7. Furthermore, in this embodiment, the two bit plane selecting data B11 and B12 and one bit mode designating data B15 are stored in the block address map memory 3 by the unit of each memory block with respect to every two continuous screen addresses. In other words, the block address map memory 3, as shown by the format in FIG. 7, is constructed to store the row addresses Y between 0 and 4th bits with respect to every two continuous screen address, the column addresses X between 5th and 10th bits, the plane selecting data B11 and B12 at 11th and 12th bits, and the mode designating data B15 at 15th bit.

Figures 7, 8:
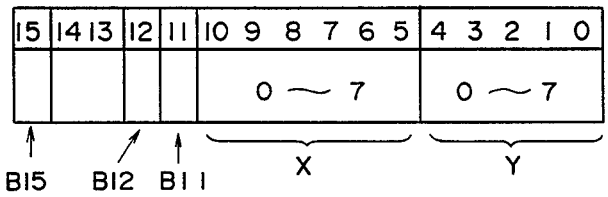
FIG. 7 shows a format of the contents stored in a block address map memory.
FIG. 8 shows a relation between the plane selecting data and the selected planes.

FIG. 8 shows the relation between the plane selecting data B11 and B12 and the selected planes 1R, 1G, 1B and 1I. When the number of planes is larger than four, the number of bits in the plane selecting data need only be increased.

The mode designating data displays by logical "0" a first display mode of superposing the contents of the entire planes such as the region 30*a* in FIG. 3, and by logical "1" a second display mode of displaying the content of only one selected plane such as another region 30b and the like in the same drawing.

Thus, the first embodiment of the invention is provided with a control memory for storing the plane selecting data and a memory for storing the mode designating data, as part of the block address map memory. Alternatively, both memories may be disposed independently of each other.

When the aforesaid plane selecting data B11 and B12 and the mode designating data B15 are read out from the block address map memory 3 and introduced into a plane selecting circuit 12 provided at the post stage of parallel/serial conversion circuits 6R through 6I, the selected output of the image data is developed from the circuit 12 according to the above input data.

Figure 9:
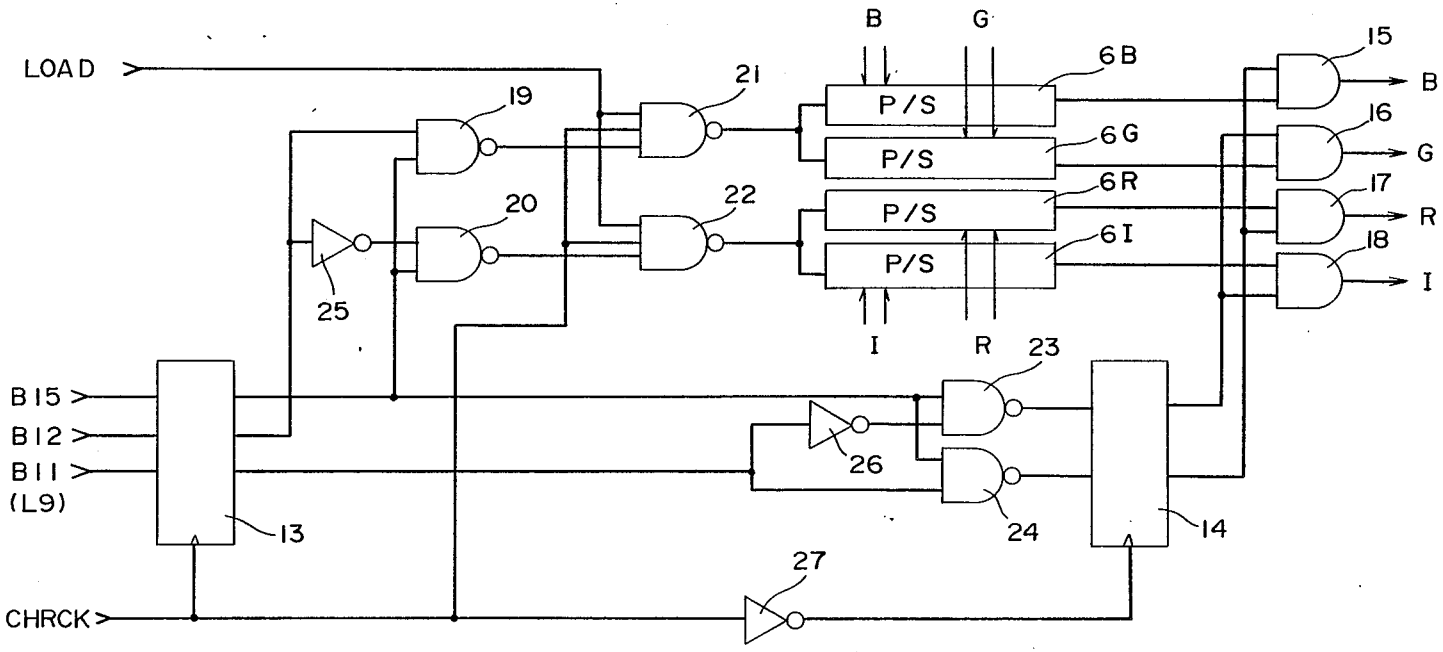
FIG. 9 is a circuit diagram of a plane selecting circuit.
Figure 10:
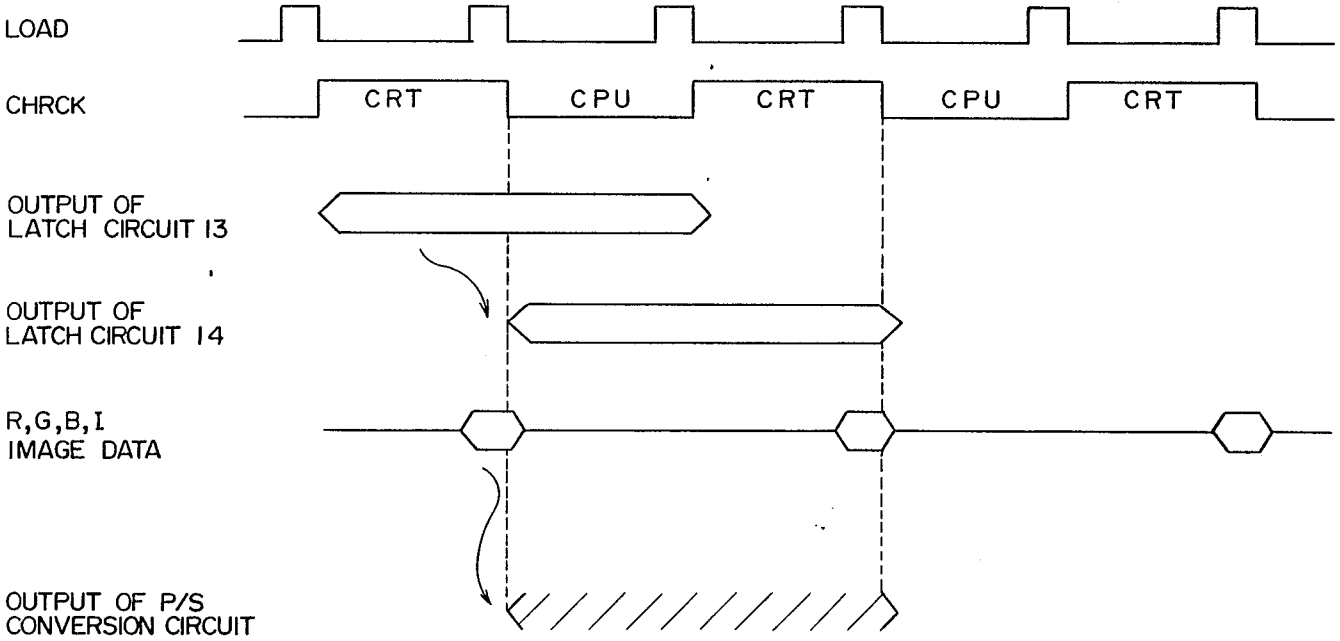
FIG. 10 is a timing chart showing operation of the plane selecting circuit.

FIG. 9 is a circuit diagram of the plane selecting circuit 12 and FIG. 10 is a timing chart showing the contents of operation of the plane selecting circuit 12.

In FIG. 9, reference numerals 13 and 14 designate latch circuits each using the character clock CHRCK as the latch pulse, 15 through 18 designate AND gates connected to the outputs of parallel/serial conversion circuits 6B through 6I respectively, 19 through 24 designate NAND gates, and 25 through 27 designate inverters respectively.

Now, a load signal to load the image data from each plane at the image memory 1 on the parallel/serial conversion circuits 6B through 6I is given into the NAND gates 21 and 22.

At first, assuming that the mode designating data B15 at logical "0" to specify the first display mode is input, the corresponding output of latch circuit 13 goes to logical "0" and the outputs of NAND gates 19 and 20 always go to logical "1", whereby the NAND gates 21 and 22 are enabled, so that when the load signal LOAD and the character clock CHRCK both are at logical "1", both the NAND gates 21 and 22 output signals of logical "0", and the entire parallel/serial conversion circuits 6B to 6I are loaded of the parallel image data from the respective planes 1B through 1I so as to be converted into the serial data. On the other hand, the output of latch circuit 13 corresponding to the mode designating data B15 disables the NAND gates 23 and 24, whereby the outputs thereof always go to logical "1". When the character clock CHRCK trails, both the outputs of the latch circuit 14 go to logical "1", whereby the AND gates 15 through 18 are entirely enabled. Therefore, the image data read out from the respective planes R, G, B and I are output simultaneously and the images of the planes superposed on each other are displayed on the screen, which enables the display with 16 colors. In addition, in FIG. 10, the time period of each CRT designed in the character clock CHRCK shows the read timing of the memory by the CRT controller 2, the same designated by each CPU showing the read/write timing of the memory by the CPU7, in other words, the memory being given the address of the CPU7 or the CRT controller 2 by the multiplexer 10.

Next, we would assume that the mode designating data B15 is at logical "1" of specifying the second display mode and the plane selecting data B11 and B12 both are at logical "0".

In this case, upon introducing the data into the latch circuit 13, since the mode designating data B15 is a logical "1", the NAND gates 19 and 20 are enabled, but since the plane selecting data B12 is a logical "0", the output of NAND gate 19 goes to logical "1" to enable the NAND gate 21 and the output of NAND gate 20 goes to logical "0". Hence, the output of NAND gate 22 goes to logical "1" independently of other two signals and the parallel/serial conversion circuits 6R and 6I are not loaded of the image data from the planes 1R and 1I, thereby outputting no serial data. While, since the NAND gate 21 is enabled, when the load signal LOAD and the character clock CHRCK both go to logical "1", the output of NAND gate 21 goes to logical "0", thereby loading on the parallel/serial conversion circuits 6B and 6G the image data from the planes 1B and 1G respectively.

At this state, the planes 1B and 1G corresponding to B and G have been selected.

Now, when the output of latch circuit 13 corresponding to the mode designating data B15 goes to logical "1", the NAND gates 23 and 24 are enabled, but since the plane selecting data B11 is at logical "0", the output of NAND gate 23 goes to logical "0" and the output of NAND gate 24 goes to logical "1". Hence, the AND gates 15 and 17 are enabled and other AND gates 16 and 18 are disabled. However, since the image data of the plane 1R is not loaded, only the image data of the plane 1B is output through the AND gate 15, in other words, the plane 1B only is selected.

Similarly, as shown in FIG. 8, combination of plane selecting data B11 and B12 will decide the plane to be selected. The plane selecting data B11 and B12, which are stored in the block address map memory 3 by the unit of memory block of $8\times8$ dots, are selectable of the plane by the unit of memory block.

Next, an example is shown which displays the image for the desired address at each plane in the second display mode and inclusively in a desired position on only one screen.

The image data is written in the entire planes 1R through 1I. Next, explanation will be given on a case where the image data written in areas R1 (the range from X=0 to 3 and Y=0 to 1 in the block address), G2 (X=0 to 1 and Y=0 to 1), B3 (X=6 to 7 and Y=4 to 7), and I4 (X=4 to 7 and Y=0 to 3) are displayed on the left upper portion, right lower portion, right upper portion and left lower portion of the screen respectively.

In this case, at first, the line address map memory 4, as shown in FIG. 14, is normally set to increase the line address LA in the order as the row address Y and raster address RA at the block address increase. On the other hand, into the block address map memory 3, as shown in FIG. 15, the coordinate (0, 1) representing the R plane (1R) as the plane selecting data (B11, B12) with respect to the screen addresses MA of 0 to 7 and 12 to 19 (corresponding to the left upper portion on the screen of CRT30) are written, and coordinates (0, 0), (1, 0), (2, 0) and (3, 0) and (0, 1), (1, 1), (2, 1) and (3, 1) of the memory block to be displayed by the R plane (1R) are written as the row address and column address (X, Y) with respect to the screen addresses MA of 0 to 7 and 12 to 19 respectively. Also, in the block address map memory 3, coordinate (1, 0) representing the G plane 1G is written as the plane selecting data (B11, B12) with respect to the screen addresses 56 to 59 and 68 to 71 (corresponding to the right lower portion on the screen of CRT30), and coordinates (0, 0), (1, 0) and (0, 1), (1, 1) of the memory block to be displayed as the block address (X, Y) by the G-plane (1G) are written.

Similarly to the above, the plane selecting data B11 and B12 showing the planes to be selected and the block address (X, Y), showing the coordinate of the memory block to be displayed are written in the same with respect to each screen address corresponding to the right upper portion and the left lower portion on the screen of CRT30.

Figure 12:
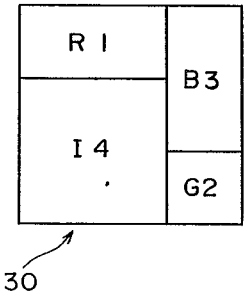

Then, in the left upper, right lower, right upper and left lower portions on the screen of CRT30 as shown in FIG. 12 are displayed the contents of areas R1, G2, B3 and I4 at the memory planes 1R, 1G, 1B and 1I respectively.

Figure 11:
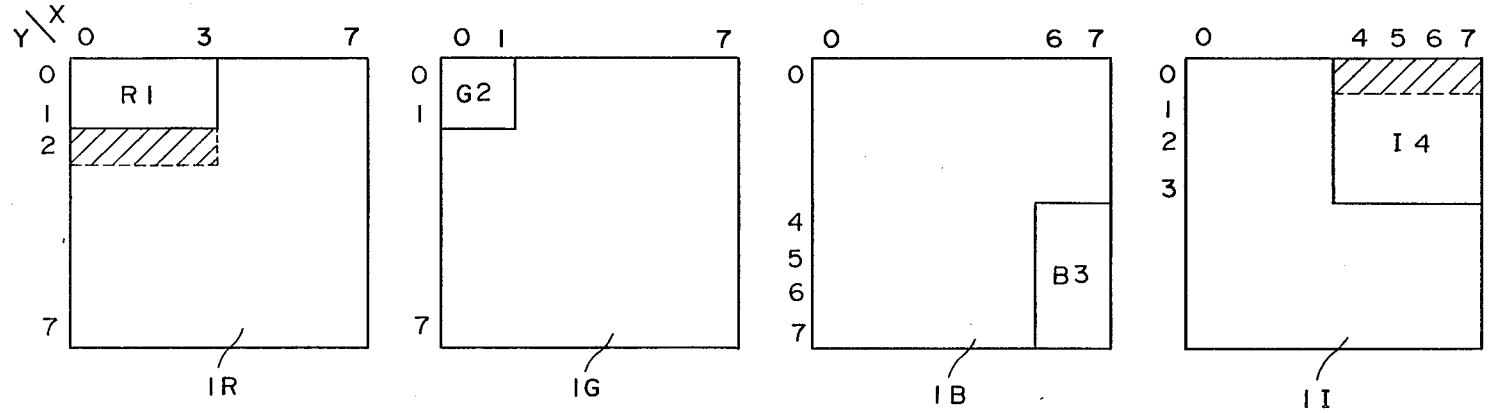
FIGS. 11 to 13 are illustrations of a second display mode.
Figure 13:
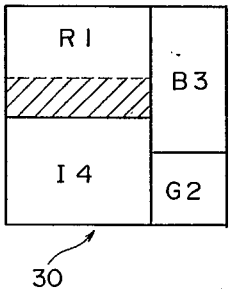
Figure 16:
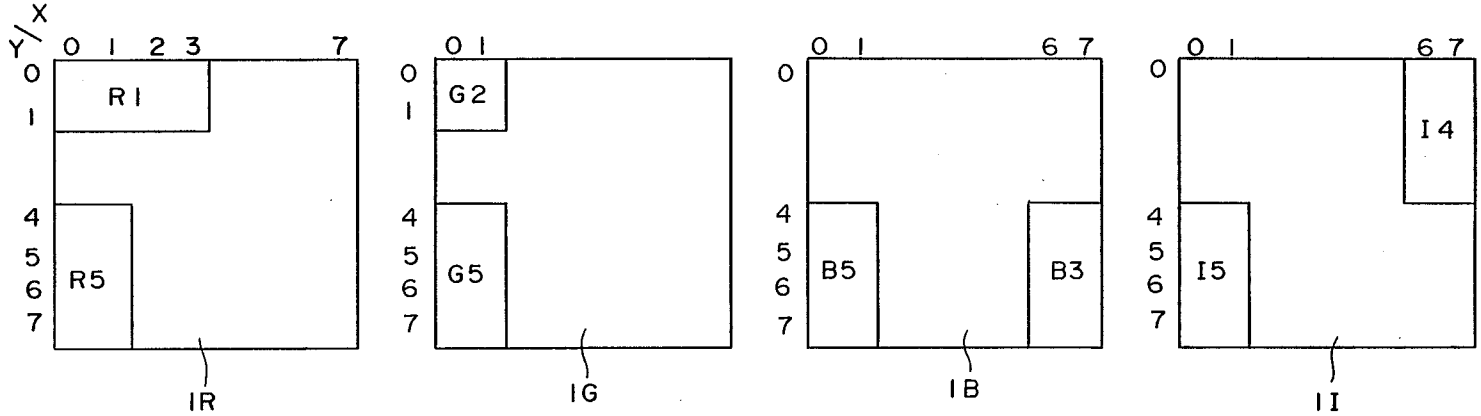
FIGS. 16 and 17 are illustrations of first and second display modes when inclusive.

In a case where the display area on the plane 1R is intended to expand in a manner of eroding a display area of the plane 1I, the coordinate (1, 1) of plane selecting data B11 and B12 is rewritten into (0, 1) and further the block addresses, (4, 0), (5, 0), (6, 0) and (7, 0), as shown by the plane 1R in FIG. 11, are rewritten into (0, 2), (1, 2), (2, 2) and (3, 2), so that the image at a hatched portion on the R-plane 1R, as shown in FIG. 13, is displayed in place of the image at a hatched portion on the I-plane 1I in FIG. 11.

As seen from the above, even when the image data is written independently in each plane at the image memory 1, it is possible that the image of desired address for each plane is selected by unit of one memory block and displayed inclusively in a desired position on one screen.

Now, since the aforesaid embodiment depends upon the second display mode, the mode designating data B15 for each screen address, which is not clarified in FIG. 15, goes entirely to logical "1".

In addition, in this embodiment, the mode designating data B15 is stored in the block address map memory 3 to thereby enable the mode designation by unit of memory block. Alternatively, for example, a mode designating register of one bit may be provided so that the CPU7 may rewrite the contents of the register when one screen scanning is completed, or corresponding to operation of a mode designating key. On the contrary, assuming that the mode designating data B15 goes inclusively to logical "0" and "1", the first display mode is displayable on part of the screen and the second display mode on another part.

In such example, the image data written-in the areas R1, G2 and B3 as the same as the above-mentioned are displayed on the left upper portion, right lower portion and right upper portion, the image data written in the area I4 (in a range of block address X=6, 7 and Y=0 to 3) is displayed on the left lower portion, and the same written in the area R5 through I5 (all in a range of block address X=0, 1 and Y=4 to 7) are superposed on each other to be displayed on the central lower portion. In addition, the line address map memory 4 is set as the same as FIG. 14.

Figure 17:
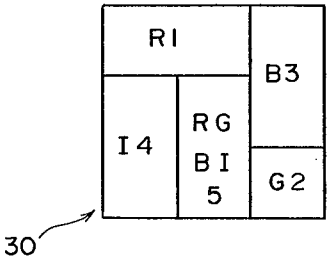

On the other hand, as shown in FIG. 18, in the block address map memory 3 are written the mode designating data B15 at logical "0" with respect to the screen addresses 28 to 31, 40 to 43, 52 to 55 and 64 to 67 to superpose and display the images in the areas R5 to I5, and are written the same at logical "1" as the mode designating data B15 with respect to other screen addresses. Also, 0 and 1 showing the coordinate of the memory block in common to each plane, wherein the images R5, G5, B5 and I5 are stored, are written as the column address X, and 4 to 7 as the row address Y corresponding in the order to each other with respect to the screen addresses to be superposed and displayed. Incidentally, the plane selecting data B11 and B12 are not defined, but represented by (0, 0) herewith. Furthermore, the coordinate (0, 1) representing the R-plane 1R are written-in as the plane selecting data B11 and B12 with respect to the screen address 0 to 7 and 12 to 19, (0, 0), (1, 0), (2, 0) and (3, 0) and (0, 1), (1, 1), (2, 1) and (3, 1) showing coordinates for the memory block storing therein the image R1 are written as the column address and row address (X, Y) with respect to the screen addresses 0 to 7 and 12 to 19 respectively, and (1, 0) showing coordinate for the G-plane 1G are written as the plane selecting data B11 and B12 and (0, 0), (1, 0) and (0, 1), (1, 1) showing coordinates for the memory block storing therein the image G2 are written as the column address and row address (X, Y), with respect to the screen addresses 56 to 59 and 68 to 71 respectively. Then, similarly to the above, the plane selecting data B11 and B12 showing the plane to be selected and the block addresses X and Y representing the coordinate of the memory block storing therein the images B3 and I4, thereby enabling the display as shown in FIG. 17 to be obtained. In addition, the first embodiment is provided with the line address map memory 4, in which the row address Y and raster address RA may alternatively be directly given as the address information in the image memory 1.

Second Embodiment

In the first embodiment, the contents to be displayed and selection of each plane depend on a unit of memory block, but the second embodiment enables them to be selected by the dot line. Hence, a larger image across a plurality of planes has been stored in the image memory so that desired part (selectable by the scan line on the screen) of the larger image is displayed on the screen, the displayed part being changeable by the block and dot line.

Next, the second embodiment will be concretely described.

Figure 22:
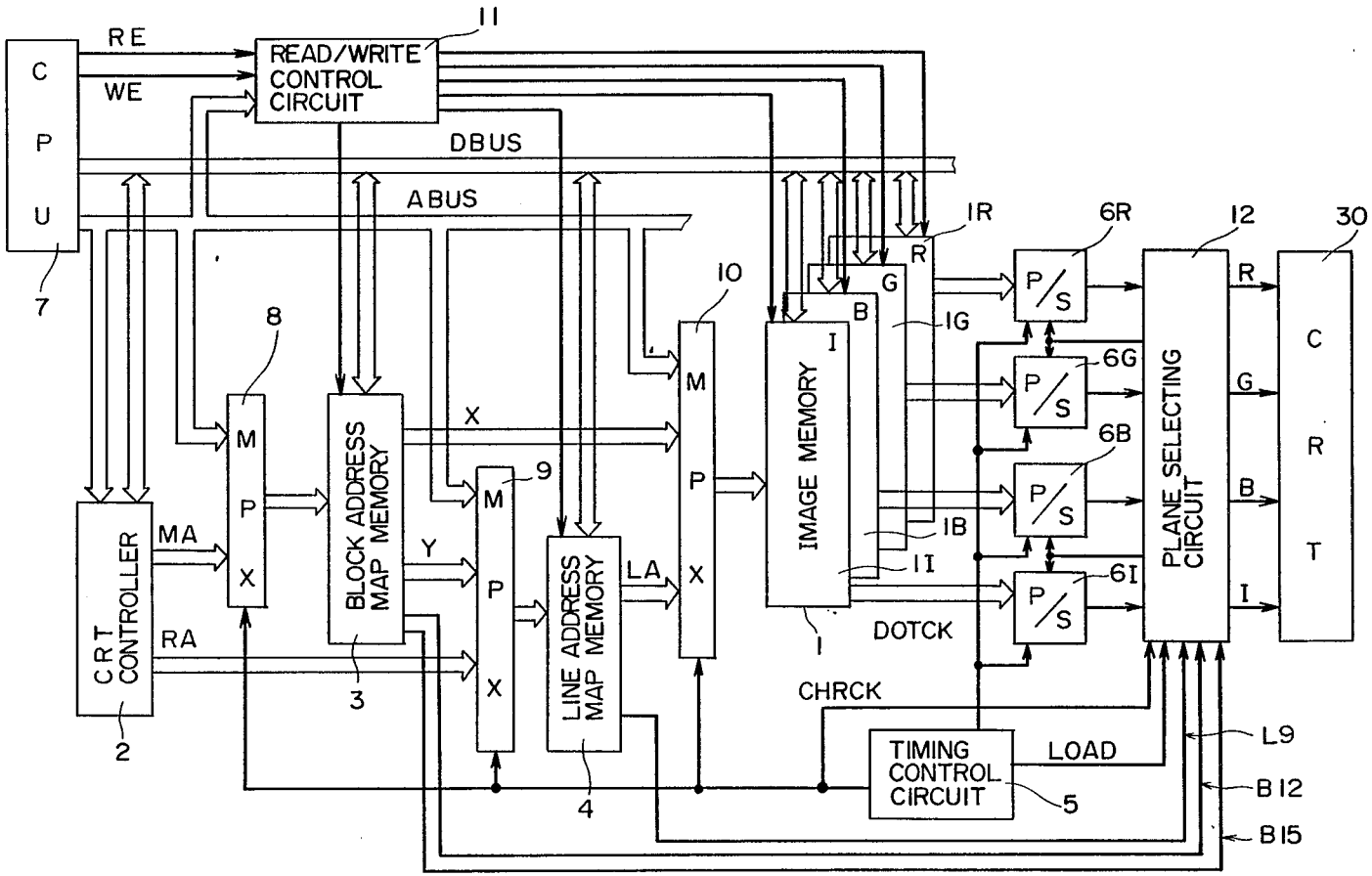
FIG. 22 is a block diagram of a second embodiment of a display apparatus of the invention.

This embodiment is constructed as shown in the block diagram in FIG. 22 and about the same as the block diagram in FIG. 4, the second embodiment being different from the first embodiment in that the plane selecting data comprises 2 bits of B12 and L9. The plane selecting data B12 of the one bit is stored in the first control memory corresponding to the screen address, the plane selecting data L9 of the other bit is stored in the second control memory with respect to the row address Y and raster address RA, and the mode designating data the same as the above-mentioned is stored in the third control memory in unit of memory block with respect to every two continuous screen addresses. The first to third control memories may be independent of each other, but are so constructed herein that the plane selecting data B12 and mode designating data B15 to be stored with respect to every two screen addresses serve as part of the block address map memory 3, and the plane selecting data L9 to be stored with respect to each value of the row address Y and raster address RA, serves as part of the line address map memory 4.

In other words, the block address map memory 3, as shown in FIG. 19, is constructed as to store therein the row address Y in the 0 to 4th bits, the column address X in the 5th to 10th bits, the plane selecting data B12 in the 12th bit, and the mode designating data B15 in the 15th bit, with respect to every two continuous screen addresses. The line address map memory 4, as shown in FIG. 20, is so constructed to store in the same the line address LA in the 0 to 8th bits, and the plane selecting data L9 in the 9th bit, with respect to each value of row address Y and raster address RA, so that the plane selecting circuit 12 provided behind the parallel/serial conversion circuits 6R to 6I selectively outputs the image data stored in the respective planes corresponding to the plane selecting data B12 and L9 and mode designating data B15.

The plane selecting circuit 12 is of circuitry the same as in FIG. 9 and different from the first embodiment in the input of L9 instead of B11.

Accordingly, when the mode designating data B15 is at logical "0" to specify the first display mode, the images of the respective planes, as the same as the former embodiment, are superimposed and displayed. When the same is at logical "1" to specify the second display mode, combination of plane selecting data B12 with L9, as shown in FIG. 8, selects the memory planes respectively.

Here, the plane selecting data B12 is stored in the block address map memory 3 in unit of memory block of 8×8 dots, the plane selecting data L9 being stored in the line address map memory 4 by the dot line, thereby enabling fine designation of the plane by 8 (in column)×1 (in row) dots.

Next, explanation will be given on the second embodiment which utilizes the aforesaid function to use the four planes 1R to 1I as the image memory of four screen sizes in continuation and a part thereof is displayed on the screen.

Figure 23:
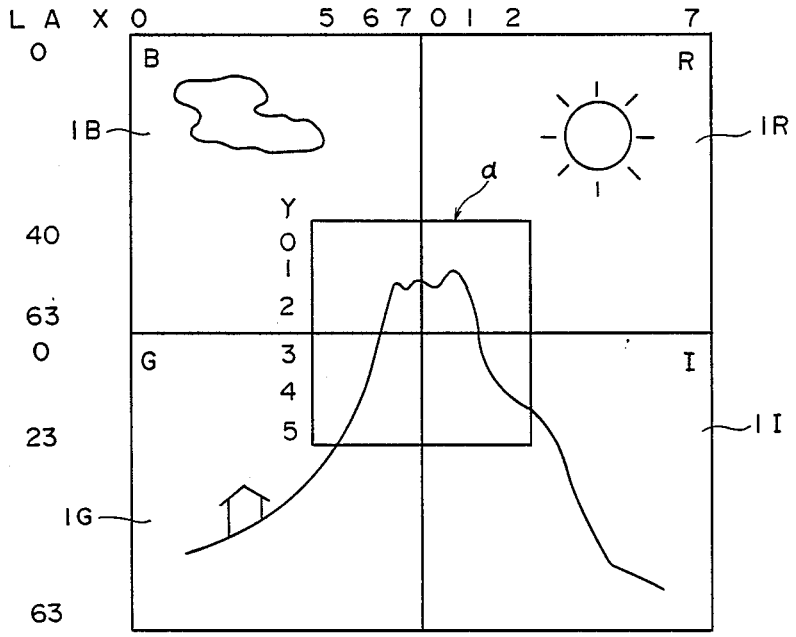
FIG. 23 is an illustration of the second embodiment.

Referring to FIG. 23, the continuous images stretched over four screen sizes from CPU7 are stored in the respective planes 1R through 1I at the image memory 1, so that the image at the central portion in contact with each plane is assumed to be displayed on the screen.

In this case, the block address map memory 3, as shown in FIG. 24, writes logical "0" as the plane selecting data B12 in the screen address corresponding to a left-hand half of the screen, and logical "1" as the plane selecting data B12 in the screen address corresponding to a right-hand half of the screen. Furthermore, coordinate (0) is written as the row address Y with respect to the screen addresses 0 to 11 on the first row, and then 1 to 5 are written in the order as the row address Y with respect to the screen addresses on the rows of 2 to 6. Also, 5 to 7 are written in the order as the column address X with respect to the screen addresses corresponding to the columns of 1 to 3 at the memory block and 0 to 2 in the order as the column address X with respect to the screen addresses corresponding to the columns 4 to 6 at the same. On the other hand, in the line address map memory 4, as shown in FIG. 25, 0 and 1 are written as the plane selecting data L9 in the screen addresses corresponding to the upper half and lower half of the screen, the serial line addresses LA of 40 to 63 are written with respect to the row addresses 0 to 2 as the raster address RA increases, and the serial line addresses LA of 0 to 23 are written with respect to the row addresses 3 to 5 as the raster address RA increases.

Thus, when the data is written in each address map memory, as shown in FIG. 23, the image data of column addresses X of 5 to 7 and of line addresses LA of 40 to 63 in the B-plane 1B is displayed at the left upper portion on the screen of CRT30, the image data of column addresses X of 0 to 2 and of line addresses LA of 40 to 63 in the R-plane 1R is displayed at the right upper portion on the screen of the same, the image data of column addresses X of 5 to 7 and of line addresses LA of 0 to 23 in the G-plane 1G is displayed at the left lower portion on the screen of the same, and the image data of column addresses of 0 to 2 and of line addresses LA of 0 to 23 in the I-plane 1I is displayed at the right lower portion. Accordingly, part of the screen of four screen size, i.e., a square portion $\alpha$ in FIG. 23, displays a crest of the mountain.

Now, when the line addresses 40 to 62 at the line address map memory 4 are rewritten into incremented values 41 to 63 and the line addresses 0 to 23 are rewritten into incremented values 1 to 24 and the line address 63 and plane selecting data 0 corresponding to the row address Y and raster address RA 2, 7 are rewritten to 0 to 1 respectively, the entire screen can be scrolled downwardly by the dot line, so that the same operations as the above are repeated, thereby enabling the image of mountain to look in continuation vertically downwardly from the crest thereof. When the decremented values are written as the line addresses LA in the order into the address map memory and the plane selecting data L9 is rewritten on the border between the planes, it is of course possible to carry out the upward dot scroll.

Also, when the column address X and plane selecting data B12 are rewritten in the block address map memory 3, it is possible to laterally move the frame in unit of memory block. For example, when the column addresses 5 to 7 are rewritten to 4 to 6, the column addresses 0, 1, 2 to 7, 0, 1, and the plane selecting data at the screen addresses (4, 5), (16, 17), (28, 29), (40, 41), (52, 53) and (64, 65) corresponding to the column address 7 are rewritten from 0 to 1, the leftward movement corresponding to 8 dots is possible.

Hence, when the contents of block address map memory 3 and line address map memory 4 are rewritten, it is possible to desirably display on the screen an image at a desired position of the image formed on the image memory of four screen size. For example, the sun on the R-plane, a cloud on the B-plane, and a house at the foot of the mountain on the G-plane, and easy to display on the screen.

Since the above embodiment depends on the second display mode, the mode designating data B15, which is not shown in FIG. 24, entirely goes to logical "1".

Also, in the aforesaid embodiment, the mode designating data B15 is stored in the block address map memory 3 so as to enable the mode designation in unit of memory block. Alternatively, for example, a mode designating register of one bit may be provided so that the content of the register may be rewritten by CPU7 when one screen scanning is over, or corresponding to operation of a mode designating key.

On the contrary, when the mode designating data is made inclusive of logical "0" and "1", part of the screen is displayed in the first display mode and another part of the same in the second display mode as shown in the following example, which is the same as the first embodiment.

Figure 26:
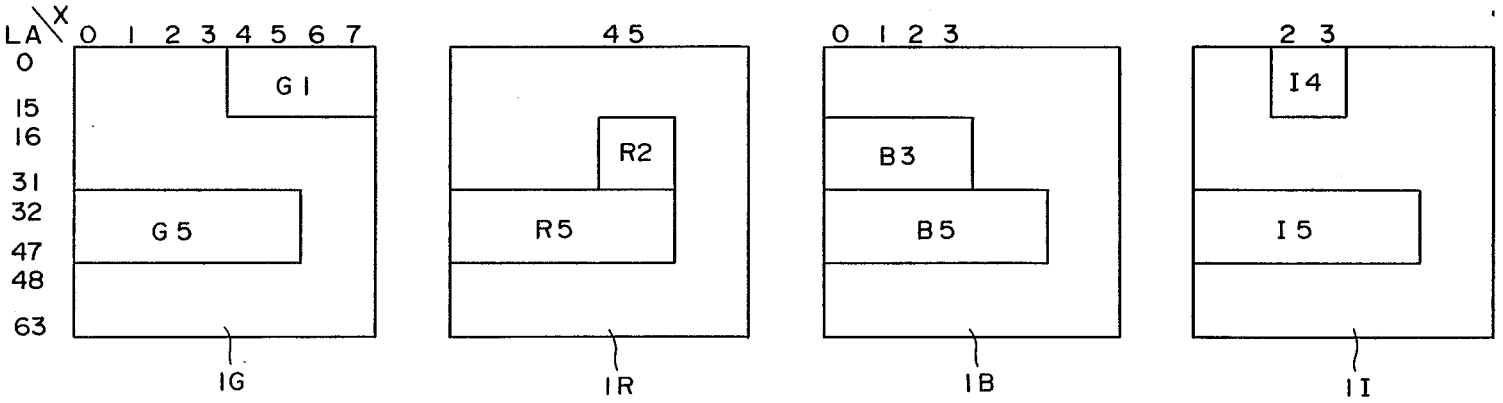
FIGS. 26 and 27 are illustrations of the inclusive display.

Now, explanation will be given on the case where the image data is written in the respective 1R through 1I as shown in FIG. 26, the images G1, R2, B3 and I4 on the respective planes being displayed independently of each other, the images G5, R5, B5 and I5 on the same addresses of the respective planes being superimposed on each other so as to be displayed.

In this case, firstly, as shown in FIG. 28, in the block address map memory 3, address 0 as the mode designating data B15 is written with respect to the screen addresses, for example, 0 to 23, to display the superimposed images G5, R5, B5 and I5, and address 1 as the data B15 is written with respect to other screen addresses. Next, address 0 as the row address Y is written-in with respect to the screen addresses 0 to 11 on the first row, and then addresses 1 to 5 as the row address Y are written-in in the order with respect to the screen addresses on the 2nd to 6th rows. With respect to the screen addresses to be displayed in superimposition, 0 to 5 representing coordinates of memory block in common to the respective planes storing therein the images G5, R5, B5 and I5 as the column address X, are written-in. Regarding other images G1, R2, B3 and I4, 4 to 7, 4 to 5, 0 to 3 and 2 to 3 representing the coordinates of memory block storing therein the respective images are written as the row address X with respect to the screen addresses to display each image. Furthermore, address 0 as the plane selecting data B12 is written with respect to the screen addresses 24 to 31, 36 to 43, 48 to 55 and 60 to 67, to display the image B3 and G1, and address 1 as the plane selecting data B12 is written-in with respect to the screen addresses, 32 to 35, 44 to 47, 56 to 59 and 68 to 71.

On the other hand, the line address map memory 4, as shown in FIG. 29, stores 0 as the plane selecting data L9 with respect to the row addresses 2 and 3, and 1 with respect to the row addresses 4 and 5. Furthermore, for the line address LA, the serial line addresses 32 to 47 in common to the respective planes storing therein the images G5, R5, B5 and I5, as the raster address RA increases, are written-in with respect to the row addresses 0 and 1. Next, similarly, the line addresses 16 to 31 storing therein the images B3 and R2 are written in the order with respect to the row addresses 2 and 3 and the line addresses 0 to 15 storing therein the images G1 and I4 are written-in in the order with respect to the row addresses 4 and 5 as the raster address RA increases.

Figure 27:
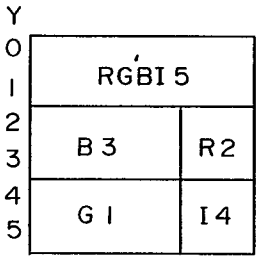

Thus, when the data is written in each map memory, the images B3, R2, G1 and I4 at the respective planes, as shown in FIG. 27, are displayed independently of each other on the left intermediate portion, right intermediate portion, left lower portion and right lower portion at one screen and also an image R G B I 5 comprising the superposed images G5, R5, B5 and I5 is displayed at the upper portion on the same screen.

Thus, the displays in the first and second display modes are developed simultaneously on the same screen.

Video signals of R, G, B and I output from the plane selecting circuit 12 are given directly in a color display so as to allow the respective planes to display the images in predetermined colors. In this case, a pallet register such as disclosed in the Japanese Patent Laid-Open Gazzette No. Sho 59-84295 is connected to the apparatus, so that the CPU rewrites the contents of the register, thereby enabling the desired color display to be obtained.

Alternatively, the aforesaid embodiments, which store the plane selecting data and mode designating data in every two continuous screen addresses through one memory block of the region specified by the two continuous screen addresses, may form the region specified by one screen address or three or more continuous screen addresses into one memory block. In this case, the plane selecting data and mode designating data need only to be stored in every one screen address or three or more continuous screen addresses, in brief, these data need only be stored in unit of memory block.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A display apparatus of a raster scan type which is provided with image memory having a plurality of planes for storage of image data and which reads out and displays the contents stored therein comprising:

a controller for generating screen addresses to specify regions on a screen partitioned into a predetermined size, and for generating raster addresses to specify dot lines on said screen;

a rewritable block address map memory for converting said screen addresses into block addresses, said block addresses specifying memory blocks formed by partitioning each of said planes of said image memory into the predetermined size so that portions of the image data are readable out respectively from said image memory via each of said memory blocks;

means for reading out said portions of the image data from said respective planes of the image memory by using said block addresses and said raster addresses;

a rewritable control memory for storing therein plane selecting data with respect to said screen addresses;

memory means for supplying data for designating a first display mode or a second display mode; and a plane selecting circuit having as input therein mode designating data given to selectively designate a first display mode or a second display mode, plane selecting data and image data read out of said image memory, said plane selecting circuit being for selecting, outputting and superimposing said portions of said image data being read out from each of said respective planes of said image memory to a respective one of said regions when data for designating said first display mode is input, and also for selecting and outputting free of superimposition said portions of said image data being read out from said respective planes of said image memory to said regions respectively in correspondence with said plane selecting data when data for designating said second display mode is input.

2. A display apparatus as set forth in claim 1, wherein said control memory is formed in part of said block address map memory.

3. A display apparatus as set forth in claim 1, which comprises another control memory for storing said mode designating data with respect to said screen addresses.

4. A display apparatus as set forth in claim 3, wherein said two control memories are formed in part of said block address map memory.

5. A display apparatus of a raster scan type which is provided with image memory having a plurality of respective planes for storage of image data and which reads out and displays the contents stored therein comprising:

a controller for generating screen addresses to specify regions on a screen partitioned into a predetermined size, and for generating raster addresses to specify dot lines on said screen;

a rewritable block address map memory for converting said screen addresses into block addresses, said block addresses comprising column addresses and row addresses representing coordinates formed by partitioning each of said planes of said image memory into the predetermined size so that portions of the image data from the image memory are readable out respectively via said coordinates;

a rewritable line address map memory for converting said row addresses and raster addresses into line addresses, said line addresses being serial and designating rows of each plane of said image memory by dot lines corresponding to said dot lines specified on said screen;

means for reading out said portions of the image data from respective planes of the image memory by using said line addresses and said column addresses;

a rewritable first control memory for storing therein first plane selecting data with respect to said screen addresses;

a rewritable second control memory for storing therein second plane selecting data with respect to said row addresses and raster addresses;

memory means for supplying data for designating a first display mode or a second display mode; and a plane selecting circuit having as input therein mode designating data given to selectively designate a first display mode or a second display mode, plane selecting data and image data read out of said image memory, said plane selecting circuit being for selecting, outputting and superimposing said portions of said image data being read out from each of said respective planes of said image memory to a respective one of said regions when data for designating said first display mode is input, and also for selecting and outputting free of superimposition said portions of said image data being read out from said respective planes of said image memory to said regions respectively in correspondence with said first and second plane selecting data when data for designating said second display mode is input.

6. A display apparatus as set forth in claim 5, wherein said first and second control memories are formed in part of said block address map memory and in part of said line address map memory respectively.

7. A display apparatus as set forth in claim 5, which comprises a third control memory for storing therein said mode designating data with respect to said screen addresses.

8. A display apparatus as set forth in claim 7, wherein said first and third control memories each are formed in part of said block address map memory, said second control memory being formed in part of said line address map memory.

* * * * *